US007571504B2

(12) United States Patent
Kuo

(10) Patent No.: US 7,571,504 B2
(45) Date of Patent: Aug. 11, 2009

(54) CUSHIONING DEVICE HAVING CHANGEABLE CUSHIONING MEMBERS

(76) Inventor: Chun Fu Kuo, No. 29, Avenue 32, Lane 667, Chonsan Road, Shem Gan Hsiang, Taichung Hsien 42950 (TW)

( * ) Notice: Subject to any disclaimer, the term of this patent is extended or adjusted under 35 U.S.C. 154(b) by 0 days.

(21) Appl. No.: 12/284,855

(22) Filed: Sep. 25, 2008

(65) Prior Publication Data

US 2009/0126107 A1 May 21, 2009

Related U.S. Application Data

(63) Continuation-in-part of application No. 11/986,430, filed on Nov. 21, 2007, now abandoned.

(51) Int. Cl.
*A47C 27/14* (2006.01)

(52) U.S. Cl. ..... 5/724; 5/690; 5/727; 5/922; 5/738

(58) Field of Classification Search ..... 5/724, 5/727, 690, 922, 652.1, 722, 638, 726, 738
See application file for complete search history.

(56) References Cited

U.S. PATENT DOCUMENTS 4,628,557 A 12/1986 Murphy ..... 5/446
4,686,724 A * 8/1987 Bedford ..... 5/652.1
4,706,313 A 11/1987 Murphy ..... 5/464
4,719,656 A 1/1988 Godinet ..... 5/401
4,737,998 A 4/1988 Johnson, Sr. ..... 5/422
5,592,706 A 1/1997 Pearce ..... 5/654
5,850,648 A * 12/1998 Morson ..... 5/724
6,401,282 B1 6/2002 Shum ..... 5/722
2006/0162087 A1 * 7/2006 Chang ..... 5/724

* cited by examiner

*Primary Examiner*—Alexander Grosz
(74) *Attorney, Agent, or Firm*—Charles E. Baxley

(57) ABSTRACT

A cushioning device includes a base support, and a number of cushioning members selectively and changeably attached onto the base support and selectively arranged to various structure by the users themselves. The cushioning members each may include such as a hexagonal cross section and arrangeable to various patterns, and each may include one or more perforations for air circulating purposes. The cushioning members may be attached to the base support with such as a hook-and-loop fastening device. The base support includes a pattern for engaging with the cushioning members and for allowing the cushioning members to be arranged to the predetermined positions according to the pattern.

7 Claims, 5 Drawing Sheets

CUSHIONING DEVICE HAVING CHANGEABLE CUSHIONING MEMBERS

The present invention is a continuation-in-part of U.S. patent application Ser. No. 11/986,430, filed 21 Nov. 2007, now abandoned.

BACKGROUND OF THE INVENTION

1. Field of the Invention

The present invention relates to a pad or mattress or cushioning device, and more particularly to a pad or mattress or cushioning device including a number of cushioning members changeably attached onto a base support and selectively arranged to various patterns or structure by the users themselves.

2. Description of the Prior Art

Typical pads or mattress members or cushioning devices comprise a number of air chambers, water chambers or air ventilation chambers or resilient members for cushioning purposes or for resiliently supporting the users.

For example, U.S. Pat. No. 4,628,557 to Murphy, U.S. Pat. No. 4,706,313 to Murphy, U.S. Pat. No. 4,719,656 to Godinet, and U.S. Pat. No. 5,592,706 to Pearce disclose four of the typical cushioning devices each comprising a number of inserts or block bodies or foam bodies assembled together.

However, the inserts or block bodies or foam bodies include an enclosed or sealed structure that the air may not flow or circulate through the inserts or block bodies or foam bodies.

U.S. Pat. No. 4,737,998 to Johnson, Sr., and U.S. Pat. No. 6,401,282 to Shum disclose two further typical modular mattress systems each comprising a number of polygonal columns assembled together for cushioning purposes.

However, similarly, the polygonal columns include an enclosed or sealed structure that the air may not flow or circulate through the polygonal columns.

The present invention has arisen to mitigate and/or obviate the afore-described disadvantages of the conventional pads or mattress members or cushioning devices.

SUMMARY OF THE INVENTION

The primary objective of the present invention is to provide a cushioning device including a number of cushioning members changeably attached onto a base support and selectively arranged to various patterns or structure by the users themselves.

In accordance with one aspect of the invention, there is provided a cushioning device comprising a base support, a plurality of cushioning members selectively and changeably attached onto the base support and selectively arranged to various structure by a user, the cushioning members each including a hexagonal cross section having a perforation formed through the cushioning members for air circulating purposes, and each including a rib extended in the perforation of the cushioning members for increasing a stiffness of the cushioning members, and an outer covering engaged onto the cushioning members and secured to the base support for stably retaining the cushioning members within the outer covering.

The cushioning members each include a fastening device for attaching to the base support, and the base support includes a fastening device for engaging with the fastening device of the cushioning members and for detachably attaching the cushioning members onto the base support.

The base support includes a pattern provided thereon for engaging with the cushioning members. The outer covering may be secured to the base support with a zipper.

The cushioning members may be made of rubber materials, gel materials, foam materials, or elastic fiber materials. The ribs of the cushioning members are preferably Y-shaped ribs. The perforations of the cushioning members are preferably circular or cylindrical perforations.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
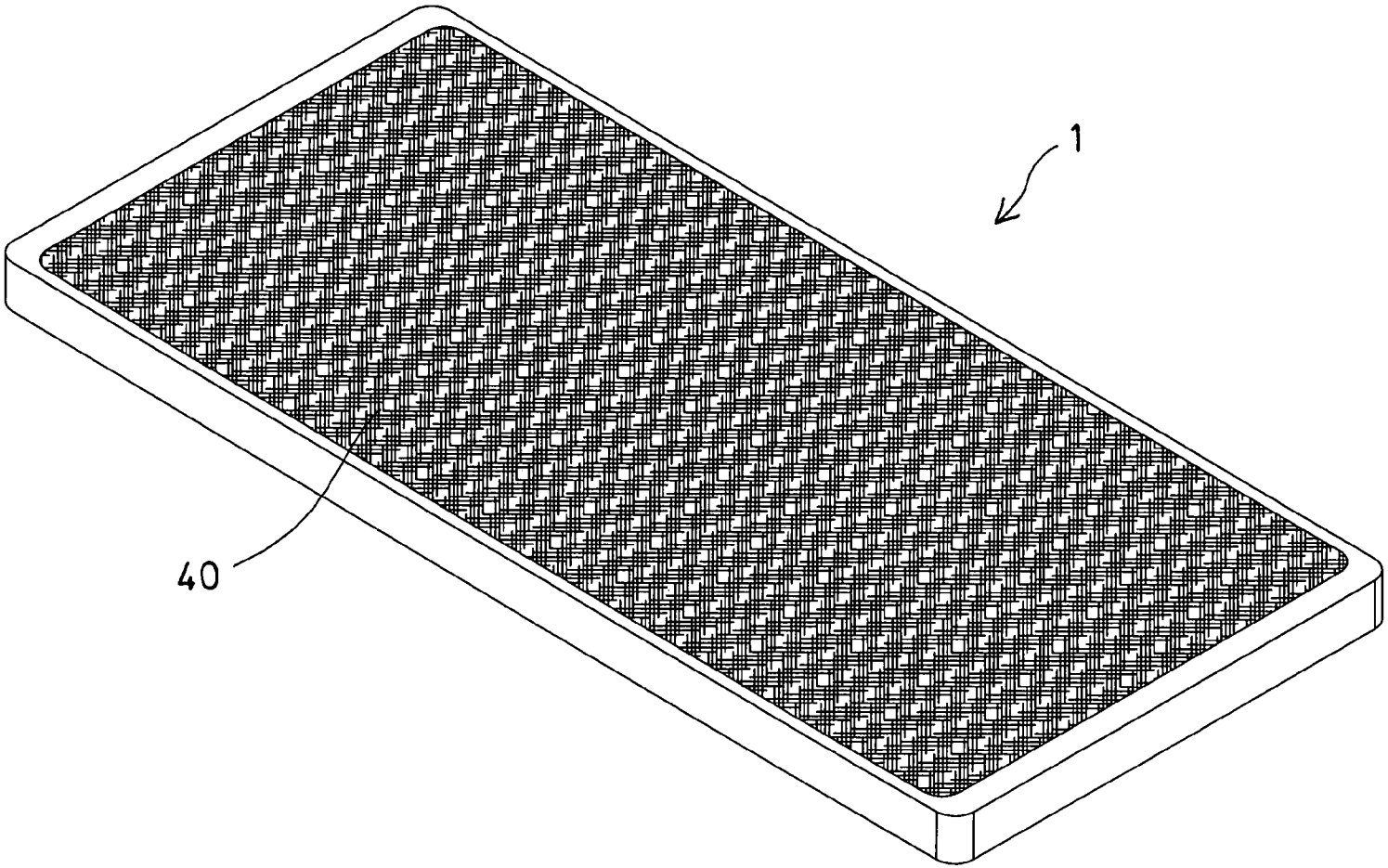
FIG. 1 is a perspective view of a cushioning device in accordance with the present invention.
Figure 2:
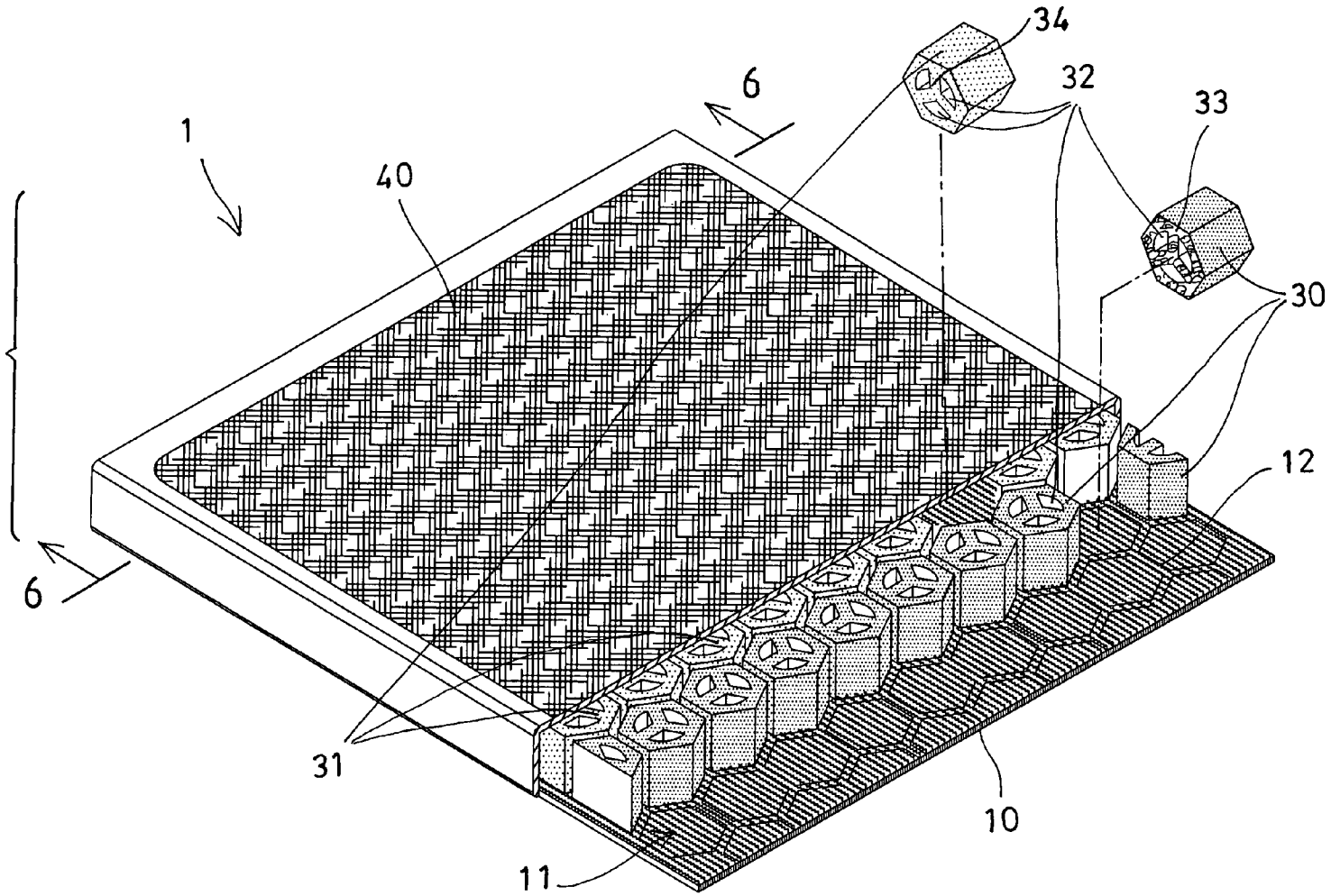
FIG. 2 is a partial exploded view of the cushioning device.
Figure 5:
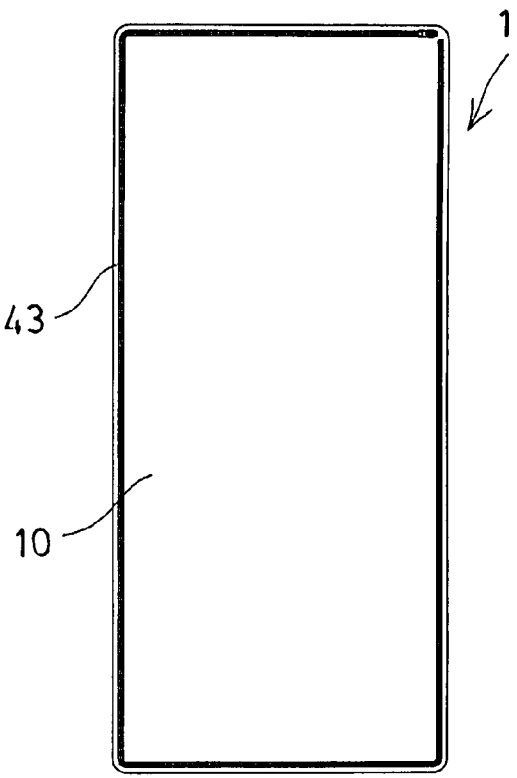
FIG. 5 is a bottom plan schematic view of the cushioning device.

Referring to the drawings, and initially to FIGS. 1-3 and 5-6, a cushioning device 1 in accordance with the present invention comprises a base layer or base support 10 including an air permeable or air circulatable structure made of such as plant fiber or other fiber materials, or other air circulating materials, and including a hook-and-loop fastening device 11 formed or provided on top of the base support 10, and optionally including a pattern 12 applied or provided on top of the base support 10 and/or on top of the fastening device 11. The cushioning device 1 further includes a number of pads or cushions or cushioning members 30, 31 to be selectively or changeably attached onto the base support 10 and to be selectively arranged to various patterns or structure by the users themselves.

It is preferable that the cushioning members 30, 31 each include a hexagonal cross section, and each include a through perforation 32, such as a circular or cylindrical perforation 32 formed therein for air circulating purposes, and each include another hook-and-loop fastening device 33 (FIG. 2) provided or attached to the upper or the bottom portion thereof for engaging with the hook-and-loop fastening device 11 of the base support 10 and for detachably attaching or securing the cushioning members 30, 31 onto the base support 10. The cushioning members 30, 31 may be attached onto the upper portion of the base support 10 and aligned with the pattern 12 applied or provided on top of the base support 10 and/or on top of the fastening device 11, or may be arranged to the other shapes or patterns or contours by the users themselves, and may be spaced from each other for a suitable or predetermined distance. The cushioning members 30, 31 each include a rib 34, such as a Y-shaped rib 34 extended or formed in the perforation 32 for increasing the stiffness of the cushioning members 30, 31, and arranged for allowing the perforation 32 to be formed through the cushioning members 30, 31.

Figure 4:
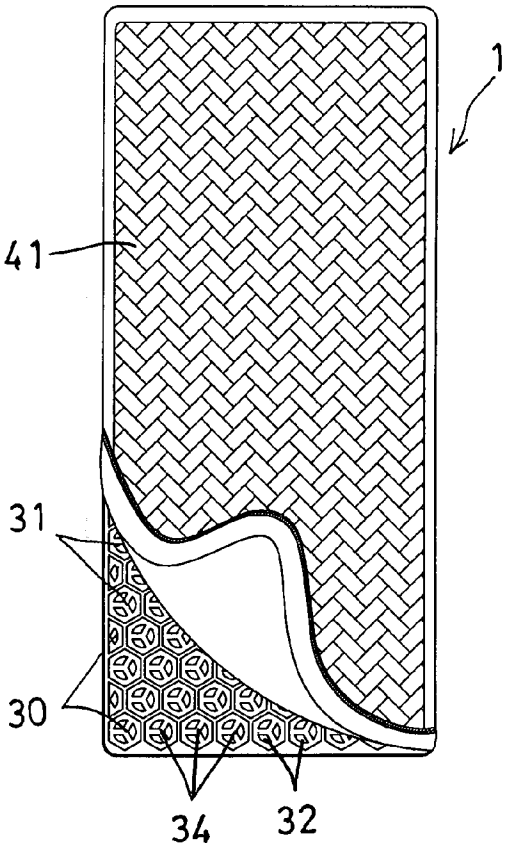
FIG. 4 is a top plan schematic view similar to FIG. 3 illustrating the other arrangement of the outer covering for the cushioning device.
Figure 3:
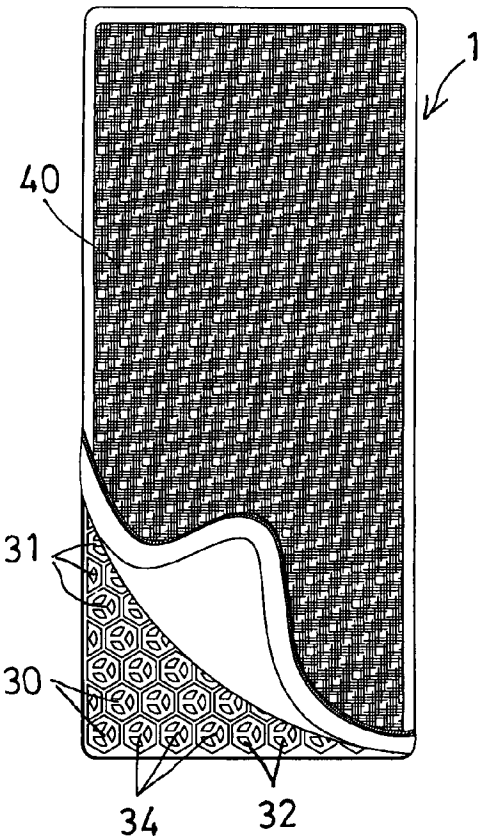
FIG. 3 is a top plan schematic view of the cushioning device, in which a portion of an outer covering has been opened for showing an inner structure of the cushioning device.
Figure 7:
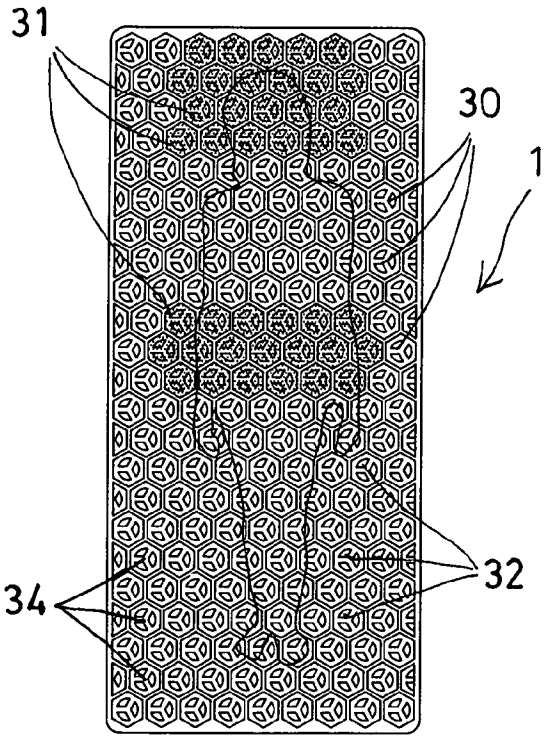
FIG. 7 is a top plan schematic view of the cushioning device, in which the outer covering has been removed for showing the inner structure of the cushioning device or for illustrating the operation of the cushioning device.
Figure 6:
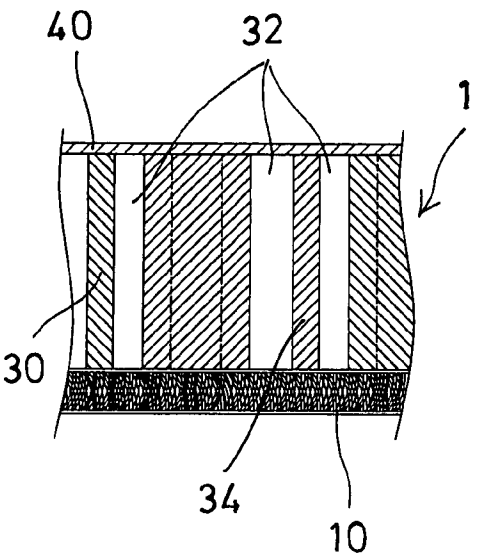
FIG. 6 is a partial cross sectional view of the cushioning device taken along lines 6-6 of FIG. 2.

In operation, as shown in FIG. 7, the cushioning members 30, 31 may also be attached onto the upper portion of the base support 10 according to the selected portions of the users that engaged with the base support 10. For example, the softer cushioning members 31 may be arranged according to the head portion and/or the buttock portion of the user for supporting the head portion and/or the buttock portion of the user that are heavier or that are required to be softly supported, and the other harder cushioning members 30 may be arranged according to the other portions of the user. The cushioning device 1 further includes an outer covering 40 (FIGS. 1-3, 6), or 41 (FIG. 4) attached or engaged onto the outer peripheral portion of the cushioning members 30, 31, and secured to the base support 10 with such as latches or fasteners or buckles or other hook-and-loop fastening device (not shown), or zippers 43 (FIG. 5) or the like.

For example, the outer covering 40 may be made of woven or non-woven materials, and the other outer covering 41 may be made of bamboo materials, cane materials, or other fiber materials that are woven together, and may include a water-resistive characteristic. The outer covering 40, 41 may be used to stably and solidly retain the cushioning members 30, 31 within the outer covering 40, 41 for maintaining the cushioning members 30, 31 at the required positions or patterns or contours. The cushioning members 30, 31 may be made of the materials selected from such as the rubber materials, the plastic or gel materials, the foam materials, the elastic fiber materials, the polymer or polyurethane materials, or other natural or synthetic materials that include a suitable resilience, and may include different heights. The cushioning device 1 particularly benefits the patients that are required to be softly and comfortably supported on the cushioning device 1 for a long time.

Figure 8:
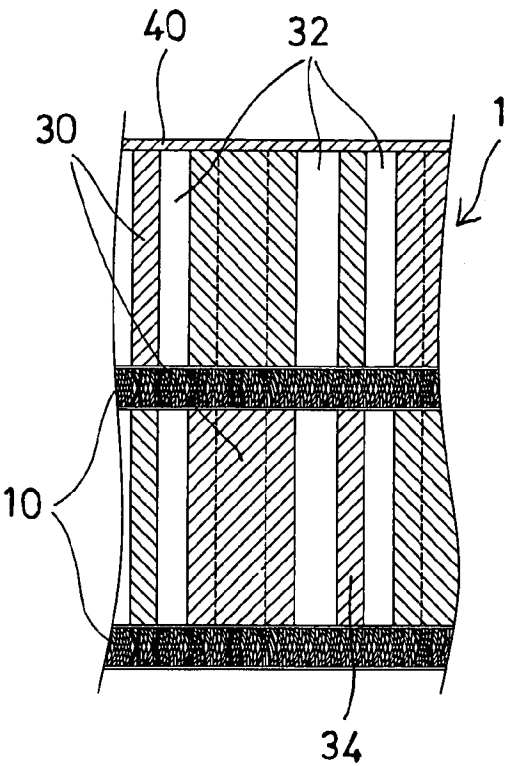
FIG. 8 is a partial cross sectional view similar to FIG. 6 illustrating the further arrangement of the cushioning device.
Figure 10:
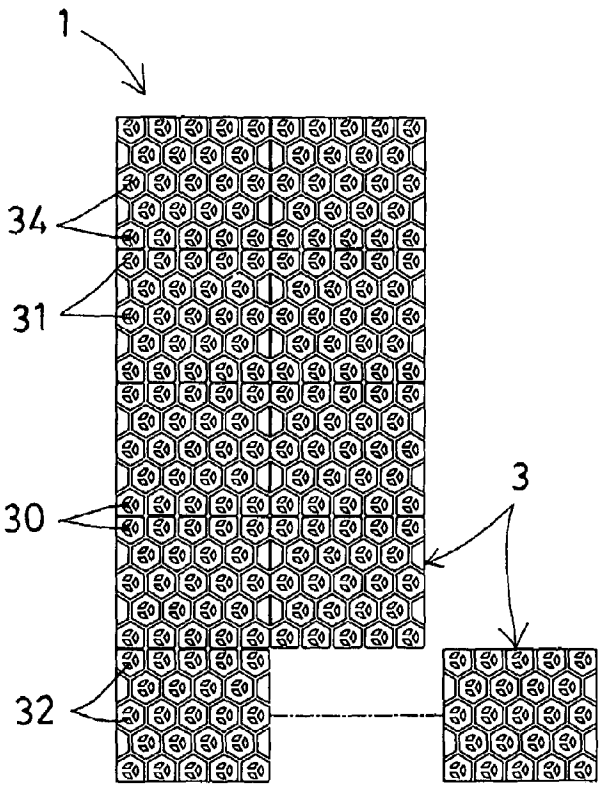
FIG. 10 is a further top plan schematic and partially exploded view of the cushioning device.
Figure 9:
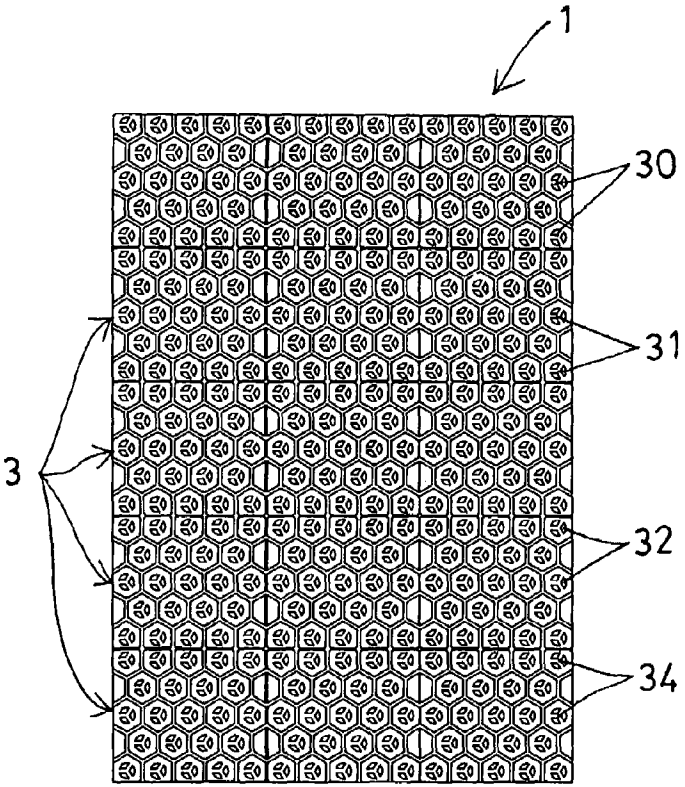
FIG. 9 is a top plan schematic view of the cushioning device similar to FIG. 7, illustrating the still further arrangement of the cushioning device.

As shown in FIG. 8, alternatively, two or more layers of the cushioning device 1 or the base support 10 and/or the cushioning members 30, 31 secured together for forming a softer and more comfortable structure. As shown in FIGS. 9 and 10, a number of cushioning members 30, 31, such as twenty five (25) cushioning members 30, 31 may be assembled or secured together for forming a number of blocks or pad units 3 and for allowing the pad units 3 to be quickly assembled or secured together to form the cushioning device 1 in accordance with the present invention.

Accordingly, the cushioning device in accordance with the present invention includes a number of cushioning members changeably attached onto a base support and selectively arranged to various patterns or structure by the users themselves.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A cushioning device comprising:

a base support, a plurality of cushioning members selectively and detachably attached onto said base support and selectively arrangeable in various configurations by a user, said cushioning members each including a hexagonal cross section having a perforation formed through said cushioning members for air circulating purposes, and each including a rib extended in said perforation of said cushioning members for increasing the stiffness of said cushioning members, and an outer covering engaged onto said cushioning members and secured to said base support for stably retaining said cushioning members in a space defined between said base support and said outer covering.

2. The cushioning device as claimed in claim 1, wherein said cushioning members each include a fastening device for attaching to said base support, and said base support includes a fastening device for engaging with said fastening device of said cushioning members and for detachably attaching said cushioning members to said base support.

3. The cushioning device as claimed in claim 1, wherein said base support includes a pattern provided thereon for engaging with said cushioning members.

4. The cushioning device as claimed in claim 1, wherein said cushioning members are made of a material selected from rubber, gel, foam, or elastic fiber.

5. The cushioning device as claimed in claim 1, wherein said outer covering is secured to said base support with a zipper.

6. The cushioning device as claimed in claim 1, wherein said ribs of said cushioning members are Y-shaped ribs.

7. The cushioning device as claimed in claim 1, wherein said perforations of said cushioning members are cylindrical perforations.

* * * * *